US009311897B2

(12) United States Patent
Subramanian et al.

(10) Patent No.: US 9,311,897 B2
(45) Date of Patent: Apr. 12, 2016

(54) CONVERGENT MATRIX FACTORIZATION BASED ENTIRE FRAME IMAGE PROCESSING

(75) Inventors: Venkatesh K. Subramanian, Bangalore (IN); Preeti Dubey, Uttar Pradesh (IN)

(73) Assignee: INDIAN INSTITUTE OF TECHNOLOGY KANPUR, Kanpur (IN)

( * ) Notice: Subject to any disclaimer, the term of this patent is extended or adjusted under 35 U.S.C. 154(b) by 200 days.

(21) Appl. No.: 13/264,712

(22) PCT Filed: Feb. 9, 2011

(86) PCT No.: PCT/IB2011/050542

§ 371 (c)(1), (2), (4) Date: Oct. 14, 2011

(87) PCT Pub. No.: WO2012/090076

PCT Pub. Date: Jul. 5, 2012

(65) Prior Publication Data

US 2013/0127886 A1 May 23, 2013

(30) Foreign Application Priority Data

Dec. 28, 2010 (IN) ..... 3119/DEL/2010

(51) Int. Cl.
*G09G 5/36* (2006.01)
*G09G 3/20* (2006.01)
(Continued)

(52) U.S. Cl.
CPC ..... *G09G 5/36* (2013.01); *G09G 3/2022* (2013.01); *G09G 3/3216* (2013.01); *G09G 3/30* (2013.01);
(Continued)

(58) Field of Classification Search
CPC .. G06F 17/30554; G06K 9/6212; G09G 5/00; G09G 3/3607; G09G 5/10; G09G 3/30; G09G 3/36
USPC ..... 345/545, 204
See application file for complete search history.

(56) References Cited

U.S. PATENT DOCUMENTS 5,541,850 A 7/1996 Vander Zanden et al.
5,566,279 A 10/1996 Katayama
(Continued)

FOREIGN PATENT DOCUMENTS

GB 2429565 A 2/2007
GB 2436377 A 9/2007
(Continued)

OTHER PUBLICATIONS

Lin, Chuan-bi, "Projected gradient methods for nonnegative matrix factorization." Neural computation 19.10 (2007): 2756-2779.*
(Continued)

*Primary Examiner* — Ming Hon
*Assistant Examiner* — Sarah Le
(74) *Attorney, Agent, or Firm* — Turk IP Law, LLC

(57) ABSTRACT

Drive signals for a display device may be generated using Separable Non-negative Matrix Series Representation (SNMSR) of source image data and applying a nonnegative matrix factorization (NNMF) process to source image data to generate approximation image data ($I_i$), partial sum image data ($P_i$) and residue image data ($J_i$). Iteratively, NNMF may be applied to $J_i$ such that subsequent $I_i$ and $J_i$ may be generated, where each $I_i$ can be associated with a corresponding sub-frame image. At each iteration, the $I_i$ may be sent to the display buffer for selective activation of multiple row and column drivers during a single sub-frame interval. At each iteration, a determination may be made if a predetermined criterion is satisfied. The iterations may be terminated and the series truncated when the predetermined criterion is satisfied. Integration of the sub-frame images displayed over a complete frame interval by human eye effectively corresponds to the source image.

11 Claims, 12 Drawing Sheets

(51) Int. Cl.
*G09G 3/32* (2006.01)
*G09G 3/30* (2006.01)

(52) U.S. Cl.
CPC .... *G09G 2310/0208* (2013.01); *G09G 2310/06* (2013.01); *G09G 2320/0247* (2013.01); *G09G 2320/043* (2013.01); *G09G 2330/025* (2013.01)

(56) References Cited

U.S. PATENT DOCUMENTS

| | | | | |
|---|---|---|---|---|
| 5,585,942 | A | 12/1996 | Kondo | |
| 5,696,937 | A | 12/1997 | White et al. | |
| 5,774,133 | A | 6/1998 | Neave et al. | |
| 5,793,871 | A | 8/1998 | Jackson | |
| 6,111,584 | A | 8/2000 | Murphy | |
| 6,175,352 | B1 | 1/2001 | Kay et al. | |
| 6,332,838 | B1 | 12/2001 | Yamagami | |
| 6,396,976 | B1 | 5/2002 | Little et al. | |
| 6,442,058 | B2 | 8/2002 | Mori | |
| 6,614,431 | B1 | 9/2003 | Collodi | |
| 6,738,357 | B1 | 5/2004 | Richter et al. | |
| 6,772,269 | B1 | 8/2004 | Kaganoi | |
| 7,050,425 | B2 | 5/2006 | Richter et al. | |
| 7,071,937 | B1 | 7/2006 | Collodi | |
| 7,075,924 | B2 | 7/2006 | Richter et al. | |
| 7,605,353 | B2 | 10/2009 | Greenberg | |
| 7,940,236 | B2 | 5/2011 | Miller et al. | |
| 7,944,410 | B2 | 5/2011 | Smith et al. | |
| 8,300,057 | B2 | 10/2012 | Smith et al. | |
| 2007/0085779 | A1 | 4/2007 | Smith et al. | |
| 2008/0186319 | A1* | 8/2008 | Boner | 345/545 |
| 2008/0246703 | A1* | 10/2008 | Smith | 345/80 |
| 2008/0259004 | A1* | 10/2008 | Miller et al. | 345/76 |
| 2009/0128459 | A1 | 5/2009 | Smith et al. | |
| 2009/0128571 | A1* | 5/2009 | Smith et al. | 345/519 |
| 2009/0322724 | A1 | 12/2009 | Smith | |

FOREIGN PATENT DOCUMENTS

| | | | |
|---|---|---|---|
| JP | 2008515018 | A | 5/2008 |
| JP | 2008525837 | A | 7/2008 |
| JP | 2009506354 | A | 2/2009 |
| JP | 2009530681 | A | 8/2009 |
| JP | 2009530682 | A | 8/2009 |
| JP | 2009530730 | A | 8/2009 |
| WO | 2006035248 | A1 | 4/2006 |

OTHER PUBLICATIONS

Lee et al., "Algorithms for Non-negative Matrix Factorization", in T. K. Leen, T. G. Dietterich, and V. Tresp, editors, Advances in Neural Information Processing Systems 13, pp. 556-562. MIT Press, 2001.
Gonzales et al., "Accelerating the Lee-Seung Algorithm for Non-negative Matrix Factorization", Technical report, Department of Computational and Applied Mathematics, Rice University, 2005.
Lee et al., Learning the Parts of Objects by non-negative Matrix Factorization, Nature, 401:788-791, 1999.
Paatero et al., "Positive Matrix Factorization: A Non-negative Factor Model with Optimal Utilization of Error" Environmetrics, 5: 111-126. doi: 10.1002/env.3170050203 (1994).
Berry et al, "Algorithms and Applications for Approximate Nonnegative Matrix Factorization", Computational Statistics and Data Analysis, 2006, 31 pages.
Lin. Projected Gradient Methods for Non-negative Matrix Factorization, Department of Computer Science, National Taiwan University, Taipei, 27 pages.
Harney, A technique for multi-line addressing in OLED Displays, Oct. 5, 2009 7:00 AM EDT, 4 pages.
Smith, Advanced System Development Group, Cambridge Display Technology, Godmanchester, 8.3: Total Matrix Addressing (TMA™) Cambridgeshire, UK.
Xu et al., 8.4: A New Addressing Scheme for PM OLED DisplayInstitute of microelectronics, Saarland University, Im Stadtwald A5.1, D-66123 Saarbrücken, Germany, Max Planck Institute for Computer Science, Optrex Europe GmbH.
Euan C. Smith, Total matrix addressing, Journal of the Society for Information Display—Feb. 2008—vol. 16, Issue 2, pp. 201-209 available online at http://dx.doi.org/10.1889/1.2841852.
PCT/IB2011/050542 International Search Report and Written Opinion mailed Jun. 3, 2011.
David Fyfe, "Total Matrix Addressing for OLED Displays", 9th Annual DisplaySearch US FPD Conference, Mar. 6-8, 2007, Hilton La Jolla, California; Cambridge Display Technology; Cambridge, United Kingdom.
Lee et al., "Algorithms for Non-negative Matrix Factorization", In T. K. Leen, T. G. Dietterich, and V. Tresp, editors, Advances in Neural Information Processing Systems 13, pp. 556-562. MIT Press, May 2001.
Gonzalez et al., "Accelerating the Lee-Seung Algorithm for Non-negative Matrix Factorization", Technical report, Department of Computational and Applied Mathematics, Rice University, Mar. 3, 2005.
Lee et al., Learning the Parts of Objects by Non-negative Matrix Factorization, Nature, 401 :788-791, Oct. 21, 1999.
Paatero et al., "Positive Matrix Factorization: A Non-negative Factor Model with Optimal Utilization of Error" Environmetrics, 5: 111-126, Jun. 1994.
Berry et al., "Algorithms and Applications for Approximate Non-negative Matrix Factorization", Computational Statistics and Data Analysis, 52:155-173, Sep. 15, 2007.
Lin, "Projected Gradient Methods for Non-negative Matrix Factorization", Neural Computation, 19:2756-2779, Oct. 2007.
Harney, "A technique for multi-line addressing in OLED Displays", EE Times, Oct. 5, 2009. Retrieved from URL: <<http://www.eetimes.com/document.asp?doc_id=1276979>>.
Smith, "8.3: Total Matrix Addressing (TMA™)," SID Symposium Digest of Technical Papers, 38: 93-96, May 2007.
Xu et al., "8.4: A New Addressing Scheme for PM OLED Display Institute of Microelectronics", SID Symposium Digest of Technical Papers, 38:97-100, May 2007.
International Preliminary Report on Patentability for PCT/IB2011/050542 filed Feb. 9, 2011, mailed on Jul. 11, 2013, issued Jul. 2, 2013.

* cited by examiner

352

300A

Heading level 1

Heading level 2

Date: 20 December 2006

Lorem ipsum dolor sit amet consect etuer adipi scing elit sed diam nonummy nibh euismod tinunt ut laoreet dolore magna aliquam erat volut.

- Ut wisi enim ad minim veniam
- quis nostrud exerci tation ullamcorper suscipit
- lobortis nisl ut aliquip ex ea commodo consequat
- Duis autem vel eum iriure dolor in
- hendrerit in vulputate velit esse molestie consequat

ORIGINAL IMAGE

354

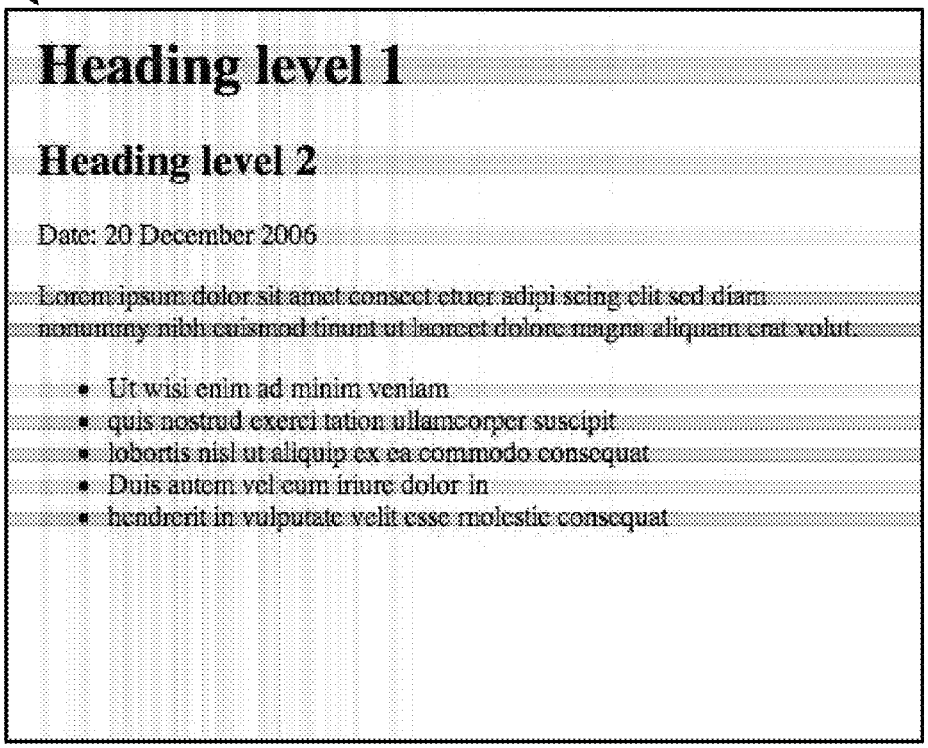

FIG. 3A

360

300C

Heading level 1

Heading level 2

Date: 20 December 2006

Lorem ipsum dolor sit amet consect etuer adipi scing elit sed diam nonummy nibh euismod tinunt ut laoreet dolore magna aliquam erat volut.

- Ut wisi enim ad minim veniam
- quis nostrud exerci tation ullamcorper suscipit
- lobortis nisl ut aliquip ex ea commodo consequat
- Duis autem vel eum iriure dolor in
- hendrerit in vulputate velit esse molestie consequat

P15

362

Heading level 1

Heading level 2

Date: 20 December 2006

Lorem ipsum dolor sit amet consect etuer adipi scing elit sed diam nonummy nibh euismod tinunt ut laoreet dolore magna aliquam erat volut.

- Ut wisi enim ad minim veniam
- quis nostrud exerci tation ullamcorper suscipit
- lobortis nisl ut aliquip ex ea commodo consequat
- Duis autem vel eum iriure dolor in
- hendrerit in vulputate velit esse molestie consequat

FIG. 3C

CONVERGENT MATRIX FACTORIZATION BASED ENTIRE FRAME IMAGE PROCESSING

CROSS-REFERENCE TO RELATED APPLICATIONS

This Application is the National Stage filing under 35 U.S.C. §371 of PCT Application No. PCT/IB2011/050542 filed on Feb. 9, 2011, which claims priority under PCT Article 8 of India Application No. 3119/DEL/2010 filed on Dec. 28, 2010. The disclosures of the PCT Application and the India Application are herein incorporated by reference in their entireties.

BACKGROUND

Unless otherwise indicated herein, the materials described in this section are not prior art to the claims in this application and are not admitted to be prior art by inclusion in this section.

Organic light-emitting diode (OLED) devices, also referred to as organic electroluminescent (EL) devices, may provide a number of advantages over other flat-panel display devices of earlier technology types. High brightness of light emission, relatively wide viewing angle, reduced device thickness, and reduced electrical power consumption are example characteristics that may be considered among the potential advantages of the OLED devices compared to, for example, liquid crystal displays (LCDs) using backlighting.

Applications of the OLED devices may include active-matrix image displays, passive-matrix image displays, and area-lighting devices such as, for example, selective desktop lighting. A common constraint in the field of display technology is the limitation imposed upon the amount of permissible instantaneous excitation that may be safely applied to individual devices in the array without causing long term harm to the picture element. OLEDs are organic light emitting diodes, and produce light when an electric current is driven through them. As current passes through the emissive materials of an OLED display, the life of the devices starts getting reduced. Specifically, the emissive materials may age proportionally to the current density passing through the materials.

The present disclosure appreciates that the technology for the production of displays by adapting LED devices is further impaired due to relatively shorter lifetimes of the light emitting devices. In comparison to conventional technologies such as LCD and Cathode Ray Tube (CRT), the OLEDs have yet to achieve a mean lifetime of 40,000 hours or more. Commercial viability of a product depends, among other things, on increased production volumes and mean lifetime.

SUMMARY

The present disclosure generally describes techniques for processing source image data with a non-negative matrix factorization (NNMF) process to generate sub-frames with partial sum image data and residue image data. The sub-frame data can be utilized to activate multiple rows and columns of the display during a single sub-frame image interval, so that a complete image may be visually integrated and perceived over successive sub-frame images.

In some examples, methods are described for generating drive signals for a display device to display a source image responsive to source image data. Example methods may include applying a non-negative matrix factorization (NNMF) process to the source image data to generate approximation image data, partial sum image data and residue image data. Some methods may also include iteratively applying the NNMF process to residue image data to generate subsequent approximation image data, partial sum image data and residue image data, where each approximation image data is associated with a corresponding sub-frame image. According to some methods, for each application of the NNMF process: the approximation image data may be sent (e.g., electrically coupled, or transmitted) to a display buffer, a determination may be made if a predetermined criterion is satisfied, and the iterations may continue until the predetermined criterion is satisfied. A total frame time may be partitioned into sub-frame times based on respective computed sub-frame image energies. The computed sub-frame images may be sent to the display device to selectively activate multiple row drivers and multiple column drivers for the display device for a duration based on corresponding sub-frame times associated with each sub-frame image.

The present disclosure further generally describes apparatuses for generating drive signals for a display device to display a source image responsive to source image data. An example apparatus may include a memory configured to store instructions source image data and a processor coupled to the memory, where the processor can be adapted to execute the instructions. When the instructions are executed the processor may apply a non-negative matrix factorization (NNMF) process to the source image data to generate approximation image data, partial sum image data and residue image data, and iteratively apply the NNMF process to residue image data to generate subsequent approximation image data, partial sum image data and residue image data, where each approximation image data is associated with a corresponding sub-frame image. For each application of the NNMF process: the approximation image data may be sent (e.g., electrically coupled, or transmitted) to a display buffer, a determination may be made if a predetermined criterion is satisfied, and the iterations may continue until the predetermined criterion is satisfied. A total frame time partitioned into respective sub-frame times based on respective computed sub-frame image energies. The apparatus may also include a display buffer, which may be configured to send the stored sub-frame images to the display device such that multiple row drivers and multiple column drivers for the display device are selectively activated for a duration based on corresponding sub-frame times associated with each sub-frame image.

The present disclosure also generally describes computer-readable storage medium having instructions stored thereon for generating drive signals for a display device to display a source image responsive to source image data. Example instructions may include generating a Separable Non-negative Matrix Series Representation (SNMSR) of the source image data, applying a non-negative matrix factorization (NNMF) process to the source image data to generate approximation image data, partial sum image data and residue image data, and iteratively applying the NNMF process to residue image data to generate subsequent approximation image data, partial sum image data and residue image data, where each approximation image data is associated with a corresponding sub-frame image. For each application of the NNMF process: the approximation image data may be sent (e.g., electrically coupled, or transmitted) to a display buffer, a determination may be made if a predetermined criterion is satisfied, and the iterations continued until the predetermined criterion is satisfied. The series may be truncated when the predetermined criterion is satisfied, where an integration of the sub-frame images displayed over a complete frame interval effectively corresponds to the source image.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The below described and other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

FIGS. 3A-3C illustrate example partial sum images created from a source image employing a matrix factorization based algorithm;

DETAILED DESCRIPTION

Figure 1:
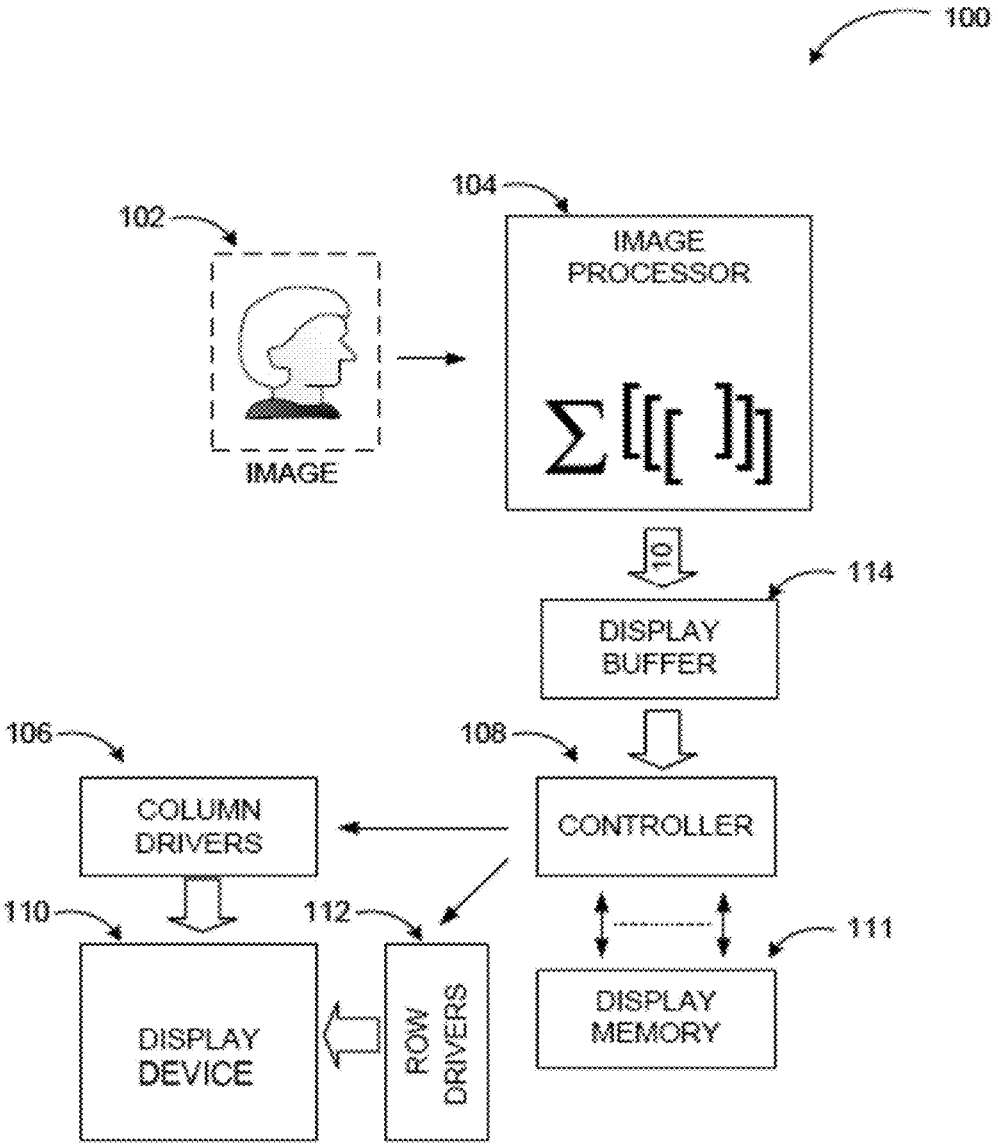
FIG. 1 illustrates a block diagram of major components in a matrix factorization based image processing system according to at least some embodiments.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

This disclosure is generally drawn, inter alia, to methods, apparatus, systems, devices, and/or computer program products related to display of images employing convergent matrix factorization and sub-frame approximation image integration.

Briefly stated, drive signals for a display device may be generated using Separable Non-negative Matrix Series Representation (SNMSR) of source image data and applying a non-negative matrix factorization (NNMF) process to the source image data to generate approximation image data ($I_i$), partial sum image data ($P_i$) and residue image data ($J_i$). Iteratively, NNMF may be applied to $J_i$ such that subsequent $I_i$ and $J_i$ may be generated, where each $I_i$ can be associated with a corresponding sub-frame image. At each iteration, the $I_i$ may be sent (e.g., electrically coupled, or transmitted) to the display buffer for selective activation of multiple row and column drivers during a single sub-frame interval. At each iteration, a determination may be made if a predetermined criterion is satisfied. The iterations may be terminated and the series truncated when the predetermined criterion is satisfied. Integration of the sub-frame images displayed over a complete frame interval by human eye effectively corresponds to the source image.

FIG. 1 illustrates a block diagram of major components in an example matrix factorization based image processing system that is arranged according to at least some embodiments described herein. In a system according to some embodiments, a plurality of the elements of a rectangular display array (multiple rows and columns) may be activated simultaneously. Initially, a source image data matrix may be expressed as a convergent series of separable matrices, each term of which may be loaded at once into the array by exciting a plurality of horizontal and vertical lines together with appropriate values. In the context of OLED based display arrays, the use of matrix factorization may result in enhanced device lifetimes, reduced flicker, as well as enhanced display brightness and contrast. The final perceived display is the perceptually integrated sum of the terms in the series.

In an example system shown in diagram 100, image processor 104 may be adapted to generate drive signals for display device 110 to display source image 102 using SNMSR of the source image data and applying an NNMF process to the source image data to generate approximation image data, partial sum image, data and residue image data. Image processor 104 may be configured to apply the NNMF process in an iterative manner to the residue image data such that subsequent approximation image data, partial sum image, data and residue image data are generated. At each iterative step, image processor 104 may be effective to send the approximation image data to display buffer 114, which may subsequently send the stored image data to controller 108. Controller 108 may selectively activate multiple row drivers 112 and multiple column drivers 106 for the display device 110 during a single sub-frame interval associated with one set of approximation image data. Controller 108 may be adapted to utilize display memory 111 to temporarily store some or all of the image data.

According to some embodiments, image processor 104 may be configured to evaluate the residue image data at each iterative step to determine if a predetermined threshold is reached, and continue the iterations if a predetermined criterion is not satisfied. Image processor 104 may be configured to terminate the iterations and truncate the series when the predetermined criterion is satisfied. The sub-frame images displayed over a complete frame interval may be effectively integrated by the human eye and such that the integrated image corresponds to the source image.

Figure 2:
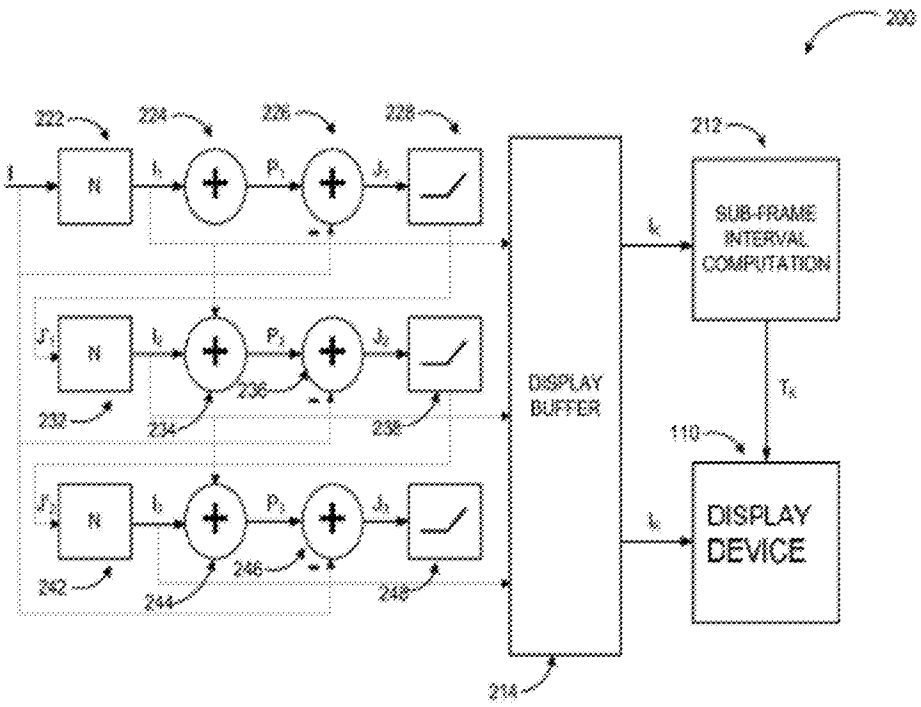
FIG. 2 illustrates an example implementation of an algorithm for generating partial sum images as a residue image converges to a predefined threshold.

FIG. 2 illustrates an example implementation of an algorithm for generating partial sum images as a residue image converges to a predefined threshold, in accordance with at least some embodiments described herein. FIG. 2 represents a single channel process such as may be utilized in a monochrome display. The same process can be applied in multiple channels, where each channel represents a separate color plane (e.g., R, G, B, etc.), and each color plane has a substantially similar arrangement to the single-channel example shown in FIG. 2. Diagram 200 illustrates an example three-step iterative NNMF process implementation for displaying a source image. The single channel example implementation may be employed in displaying monochrome images. In case of color images, multiple channels, each implementing the same process, may be utilized.

In diagram 200, I, J, and P are input signals or variables that represent the source image data, residue image data, and partial sum image data, respectively. Source image data I may be received as data that is represented as a matrix. NNMF can be applied to source image data I at block 222, which may be effective to generate first approximation image data, $I_1$. For symmetry purposes, adder 224 is shown on the first path of the iterative process, but first approximation image data $I_1$ may be considered as equivalent to the first partial sum image data $P_1$ according to some embodiments. First approximation image data $I_1$ may be sent (e.g., electrically coupled, or transmitted) to display buffer 214. During the first iteration, first partial sum image data $P_1$ may also be subtracted from source image data I by adder 226, resulting in first residue image data $J_1$. At block 228, negative values of first residue image data $J_1$ may be truncated, resulting in truncated residue image data $J'_1$.

At the second iterative step, NNMF may be applied at block 232 to truncated residue image data, $J'_1$, resulting in second approximation image data, $I_2$. Data $I_2$ may be combined with data $I_1$ at adder 234, resulting in second partial sum image data $P_2$. Second approximation image data $I_2$ may be sent (e.g., electrically coupled, or transmitted) to the display buffer 214 as well. Second partial sum image data $P_2$ may also be subtracted from data I at adder 236 resulting in second residue image data $J_2$. At block 238, negative values of data $J_2$ may be truncated resulting in truncated residue image data $J'_2$.

At the third iterative step, the operations of the second iterative step may be repeated using NNMF block 242, adders 244 and 246, and truncation block 248, obtaining third approximation image data $I_3$, third partial sum image data $P_3$, and third residue image data $J_3$, where third approximation image data $I_3$ is sent (e.g. electrically coupled or transmitted) to the display buffer 214. At each iterative step, the residue image data $J_k$ may be evaluated against a predetermined criterion and the iterations may be terminated if the criterion is satisfied (e.g., a fidelity threshold value is exceeded).

After the series has been truncated by a processor performing the iterative image processing, to, for example, K terms, the respective energies, $E_k$ (k=1, 2, . . . , K), for each sub-frame approximation image data, $I_k$ (k=1, 2, . . . , K) may be evaluated by the same processor (e.g., compared against a threshold as discussed above). Total available frame interval time, T, may be partitioned into non-overlapping sub-frame display times, $T_k$ (k=1, 2, . . . , K), according to the principle that $E_1/T_1=E_2/T_2=\ldots=E_K/T_K$ at sub-frame interval computation block 212. Next, all sub-frame approximation image data, $I_k$ (k=1, 2, . . . , K), stored in the display buffer 214 may be sent (e.g. electrically coupled or transmitted) to display device 110 along with the sub-frame display times, $T_k$ (k=1, 2, . . . , K) obtained from the sub-frame interval computation block 212. On the display device 110, the individual approximation images may be displayed through selective activation of multiple row drivers and multiple column drivers of the display device for corresponding sub-frame display times (e.g., $I_1$ for period $T_1$, $I_2$ for period $T_2$, . . . , $I_K$ for period $T_K$.

According to the conventional approaches, each pixel device may have two connections, for example, a current input lead and a ground lead. At the current input lead, the current being fed to the pixel device may be controllable over a range of 0 units to L units. At the same time, for the diode to emit light, the output ground lead may need to be coupled to a circuit ground (e.g., for single-supply systems) for the current to flow through the device. In a dual supply system, the ground may be a mid-supply, while the circuit could be between a positive supply and a negative supply. Moreover, embodiments may also be implemented in a fully differential signal drive (not ground, but difference driven) circuit as opposed to a single-ended signal drive (ground referenced) circuit. During a given frame interval time of T milliseconds, the average intensity achieved by the device may be expressed as a product of the average drive current ($I_D$) and the time ($t_D$) for which the output lead is grounded, divided by the total frame interval, $(I_D*t_D)/T$. Therefore, $0<t_D<T$ and $0<I_D<L$ are the limits that determine a range of possible average intensity of a single device.

In a display array, active rows may be driven during a frame interval while inactive rows are not driven during the same frame interval. For example, in a single-supply system, the ground leads of a given row of pixels may be shorted together, to constitute a single row ground line (i.e., output line). Similarly, the input current leads of the pixels in a column may be shorted together to constitute a single column current line (i.e., input line) in a single-supply system. Comparable arrangements may be made in a differential system. The driving of the active rows, respectively, minimizes the total number of lines emanating from an MN sized array reducing the array from 2MN to M+N. The device array may be controlled by M output lines and N input lines. To exclusively activate the (m, n)th pixel to an average intensity of $(I_D*t_D)/T$, input current $I_D$ is needed on input line n while simultaneously grounding the output line m for $t_D$ milliseconds, and keeping all other output lines open and all other input lines at 0. The other pixels in row 'm' remain dark because their input lines (input lines other than n) are being kept at 0 and all the other pixels in the column 'n' are dark only because their output lines (output lines other than m) are being kept open.

If two pixels (m, n), (m', n) in the same column are needed to be excited to two different intensities b and b', t, t' may be found that allow one to express $b=(I_D/*t_D)/T$ and $b'=(I_D*I_D')/T$. Then, current $I_D$ may be applied to input line n, while inactivating output lines m, m' for periods $t_D$, $t_D'$ respectively. As before, output lines other than m, m' are open and input lines other than n are at 0. Similarly, if two pixels (m, n) (m, n') in the same row are to be excited to two different intensities b and b', $I_D$ and $I_D'$ may be found that allow one to express $b=(I_D*t_D)/T$ and $b'=(I_D'*t_D)/T$. Currents $I_D$ and $I_D'$ may be applied to columns n, n' while inactivating output line m for time $t_D$.

The above described approach may be extended to handle any number of pixels confined to a common row or to a common column. However, when the pixels to be simultaneously excited are spread over both multiple rows as well as multiple columns, it can be shown that the intensity values in the different rows should be linearly dependent for a solution to exist. Also, simultaneously, the intensity values in different columns should be linearly dependent for a solution to exist. In general, a solution exists when the rank of the matrix of $I_D*t_D$ entries of the array is unity.

If an arbitrary source image data I is to be displayed on the array of pixels on a display, it cannot be generally assumed that the image matrix is of rank unity. Accordingly, if the image matrix of unit rank is to be displayed, then there may be no need for decomposition of the image into multiple sub-frames, as is needed for a general image. Therefore, the process of matrix factorization may be completed in one sub-frame and the entire frame time interval may become available for displaying the image provided in one sub-frame, resulting in the image having M times greater average intensity.

Displaying unit rank image matrices according to the present disclosure may be further extended with respect to arbitrary images of possibly full rank. The possibility of encountering only unit rank images being remote, the algorithm may be implemented further for an arbitrary image by representing the image as the limit of a series of unit rank images. When considered in terms of a matrix, an image needs to have a rank of unity to permit the existence of a solution. Also, an M×N sized source image matrix, $I_M$, of rank unity may be expressed as the outer product of two matrices: $I_M=W\times H$, where W has dimension M×1 and H has dimension 1×N.

Each unit rank member of the series represents an image that may be expressed as the outer product of a column with a row, but no partial sum of the members of the series may necessarily share this property of being unit rank. The gray scale images, as well as the individual channel components of a color image, may exhibit the property of being nonnegative. The components are constrained including the partial sums of the representation to possess the property of non-negativity.

Separable Non-negative Matrix Series Representation (SNMSR) yields a series representation of an arbitrary image in terms of separable images. Each member of the series may then be subjected to Non-negative Matrix Factorization (NNMF) to yield respective column and row factors.

It may be demonstrated that a substantially large portion of the energy in the series representation may be confined to the first few terms of the series. The energy as used herein refers to a sum of the square values of respective currents for each pixel element ($I_D$) in displaying a source image I. For a practical implementation of the present system, an energy threshold may be selected with an acceptable approximation error (defined as a difference between an ideal image and an integrated image viewed by the user), and the series may be truncated at an appropriate point to yield a 'finite' series. More generally, a more appropriate fidelity measure than one defined exclusively in terms of error energy may be used to determine the truncation point of the series approximation. For example, there are many perceptual error measures that may be used to determine the number of initial terms in the series representation to be retained. Each term in the series is a unit rank (separable) image data that contributes, along with the others, to yield a close approximation of the overall non-separable image. In one frame interval time of T, each member of the truncated series may be displayed once, and each such matrix may be considered as a sub-frame representation of the source image I.

However, it is not necessary that all the sub-frames that make up a frame be allocated an equal share of the frame interval time T. For SNMSR, the source image matrix may be expressed as:

$$I_M = \sum_{k=1}^{\infty} I_k, \quad [1]$$

where $I_k\times W_k\times H_k$ and $W_k$ is M×1, $H_k$ is 1×N for all k. k represents each sub-frame, for example, k=1 represents the first sub-frame, k=2 represents the second sub-frame, etc. Each $I_k$ may be called a sub-frame and a partial approximation sequence $P_k$ may be further defined based on $I_k$ as:

$$P_k = \sum_{j=1}^{k} I_j. \quad [2]$$

If $\langle I_k\rangle$ is a converging series, $\langle P_k\rangle$ is a converging sequence. Nonnegative matrix factorization may be applied on $I_k$ as $I_k\rightarrow W_1\times H_1=I_1=P_1$; $I-P_1\rightarrow W_2\times H_2=I_2$; $P_2=P_1+I_2$; $I-P_2\rightarrow W_3\times H_3=I_3$; $P_3=P_2+I_3$; and so on. $I_1$ is equivalent to $P_1$ which is first partial approximation, $P_2=I_1+I_2=P_1+I_2$; $P_3=I_1+I_2+I_3=P_2+I_3$; and so on. The energy of $k^{th}$ sub-frame ($I_k$), $E_k$, may be expressed as:

$$E(I_k) = \sum_m \sum_n I_k^2(m, n), \quad [3]$$

where m and n are dimensions of the source image matrix $I_M$ whose individual elements, $I_k$, correspond to the respective currents, $I_D$, for each pixel element. The individual elements, $I_k$ are squared and summed to determine the total energy for displaying the image.

The energy function is one that may converge rapidly within a few iterations. An approximation error, $\eta_k$, may be defined as a difference between an ideal image and an integrated image viewed by the user. Mathematically, $\eta_k$ may be expressed as a sum of squares of the difference between the source image matrix $I_M$ and the partial approximation matrix $P_M$, where $I_M$ and $P_M$ comprise individual sub-frame elements $I_k$ and $P_k$:

$$\eta_k=\|I_M-P_M\|^2. \quad [4]$$

The partial approximation error also may converge to a low value after a limited number of iterations resulting in the series of sub-frames converging to source image matrix $I_M$. The sequence of partial sums also may converge in a similar manner. Alternatively, other error measures may be applied to decide acceptability of the convergence.

Figure 3B:
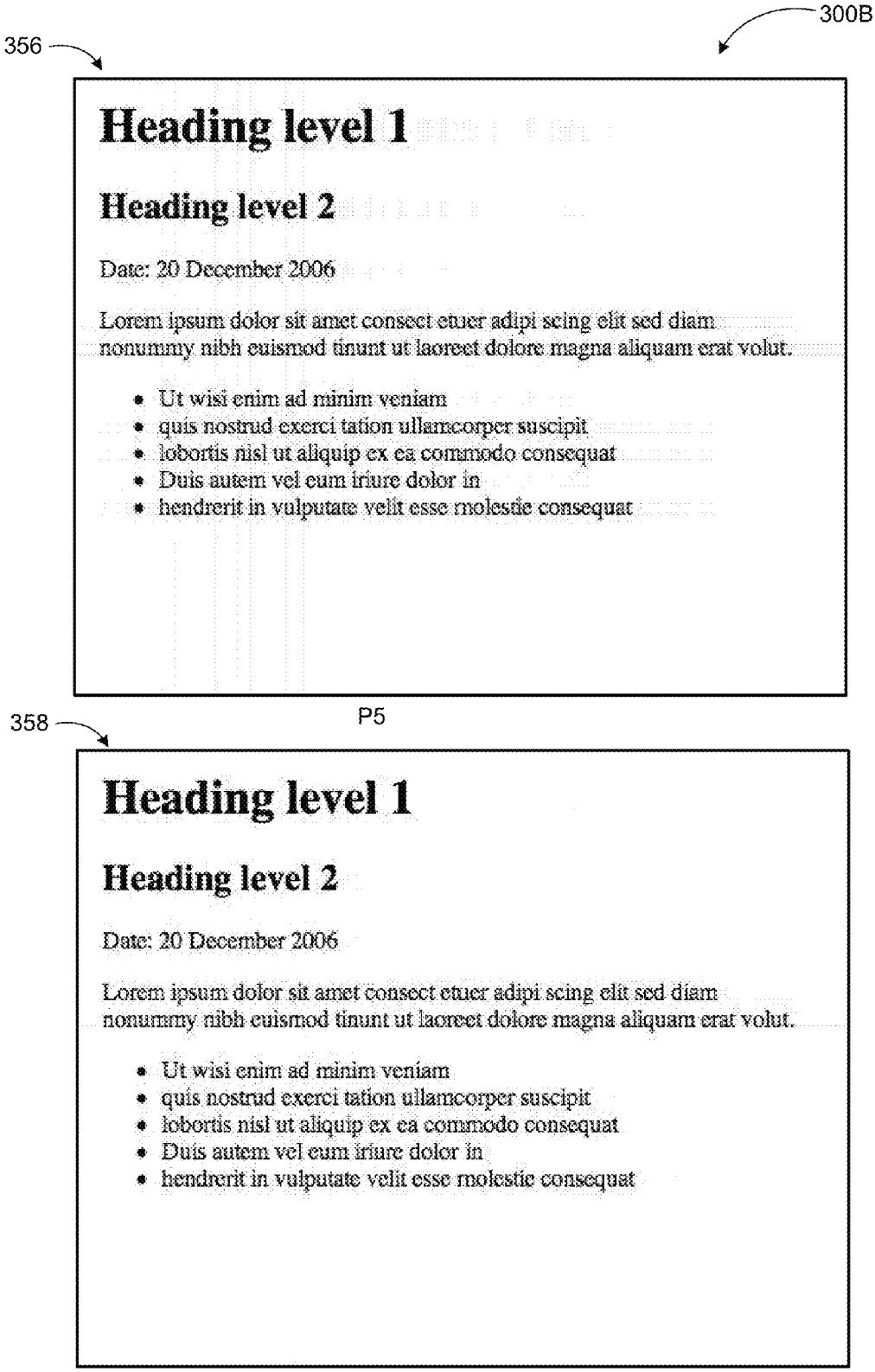

FIGS. 3A-3C illustrate example approximation images created from a source image employing a matrix factorization based algorithm. Diagrams 300A through 300C illustrate the changes in a black and white text containing source image 352 as the source image 352 is processed iteratively by applying NNMF and generating approximation images, which are displayed on a display device at each sub-frame interval and integrated by the human eye over a complete frame interval.

As discussed in more detail below, a large portion the percentage energy of the displayed image (e.g. 90%) is typically contained in the first couple of approximation images. Furthermore, energy based partial approximation error also converges relatively rapidly depending on image complexity, number of colors, etc. The example source image 352 is a relatively simple image with only black and white text. The approximation error for the simpler types of images may converge very rapidly. Indeed, as shown in the diagram, first approximation image 354 of the diagram 300A (after the first iteration) is quite legible, although the first approximation image 354 may have some image quality issues such as the horizontal and vertical shading stripes.

A difference between the partial sum images P5, P10, P15, and P20 (356 associated with a diagram 300B, 358 associated with the diagram 300B, 360 associated with a diagram 300C, and 362 associated with the diagram 300C) is almost imperceptible, however, indicating the partial approximation error reaches a sufficiently low level at $5^{th}$ iteration and the iterative process may be terminated at that step. The early termination may reduce computational resource usage as well as increases display device mean lifetime by reducing number of activations of the row and column elements.

Figure 4:
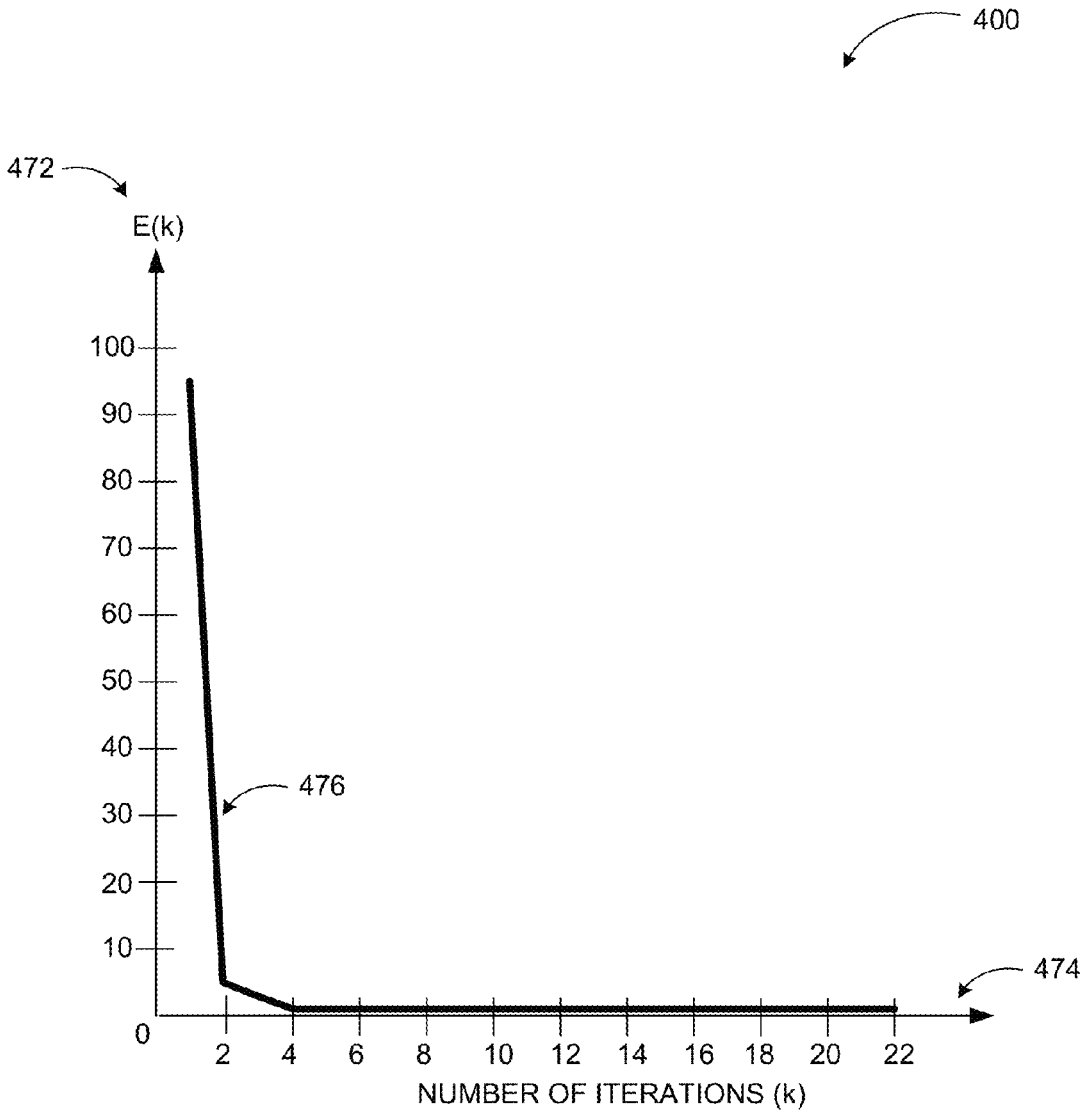
FIG. 4 illustrates a diagram of percentage energy vs. number of iterations in a display using approximation images.

FIG. 4 illustrates a diagram 400 of percentage energy vs. number of iterations in a display using approximation images with the percentage energy referring to a sum of the square values of respective currents for each pixel element ($I_D$) in displaying an image $I_k$ in each sub-frame such that an integration of the sub-frame images $I_k$ over time by the user's brain yields the source image I represented by source image matrix $I_M$. In diagram 400, the horizontal axis represents the number of iterations or sub-frames (474) and the vertical axis represents the percentage energy (472) for each sub-frame. The energy of each sub-frame may be expressed as shown in equation [3] above, where the energy of each sub-frame is determined by the sum of current terms squared associated with the activated pixels for the corresponding sub-frame.

As diagram 400 illustrates, the normalized (or percentage) energy of the sub-frames converges rapidly during the first few iterations. Indeed, the first iteration may include approximately 90% of the total energy for the displayed image, as shown by the energy curve 476. Since the energy levels rapidly converge during the first few iterations and then assume a slowly decreasing pattern, the iterations may be terminated relatively early on, for example, at iteration 5 or 10. Another consideration in determining how many iterations to perform is the partial approximation error discussed below.

Figure 5:
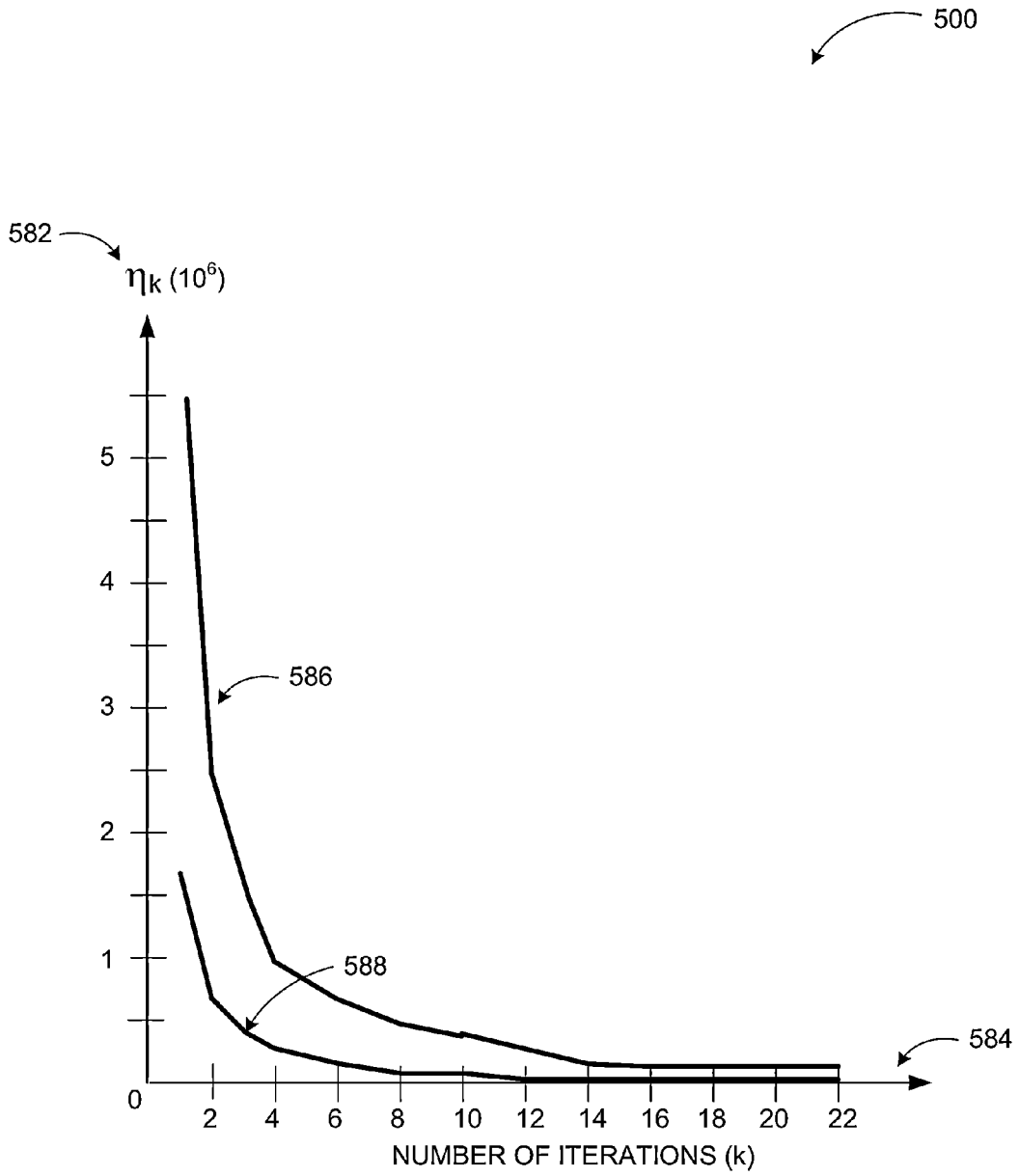
FIG. 5 illustrates a diagram of approximation error vs. number of iterations in a display using energy in residue images.

FIG. 5 illustrates a diagram of approximation error vs. number of iterations in a display using energy in residue images. In diagram 500, the horizontal axis is again number of iterations 584 and the vertical axis represents approximation error $\eta_k$ (582). The approximation error, $\eta_k$, may be computed as shown in equation [4] above.

Diagram 500 includes two example curves. Error curve 586 represents a partial approximation error for a relatively complex image with many colors and variation of light and dark regions. While the error begins higher, the error converges relatively rapidly settling to a slow pattern around $10^{th}$ iteration. Error curve 588 represents a partial approximation error for a relatively monochromatic image (i.e., shades of gray or few colors) and begins substantially lower compared to the error curve 586.

Approximation error curves 586 and 588 in FIG. 5 are shown to converge after a few iterations to a relatively small value. Hence the series of approximation images $I_k$ for each sub-frame converges to the source image matrix, $I_M$. The sequence of partial sums also converges in a similar manner to $I_M$. As discussed previously, a visually acceptable error threshold may be selected (e.g., $0.5*10^6$) to truncate the series (and thereby the computations) after a finite number of iterations.

FIGS. 3A-3C illustrate a monochromatic image, where the difference between the example source image 352 and the $5^{th}$ approximation image 356 is almost imperceptible after the $5^{th}$ iteration (e.g., see diagram 300A in FIG. 3A). Error curve 588 further reinforces that conclusion. A color comparison is not shown, but color images are relatively more complex and approximation error perceived by the human eye during integration of the sub-frames may be higher than in monochromatic images.

Figure 6:
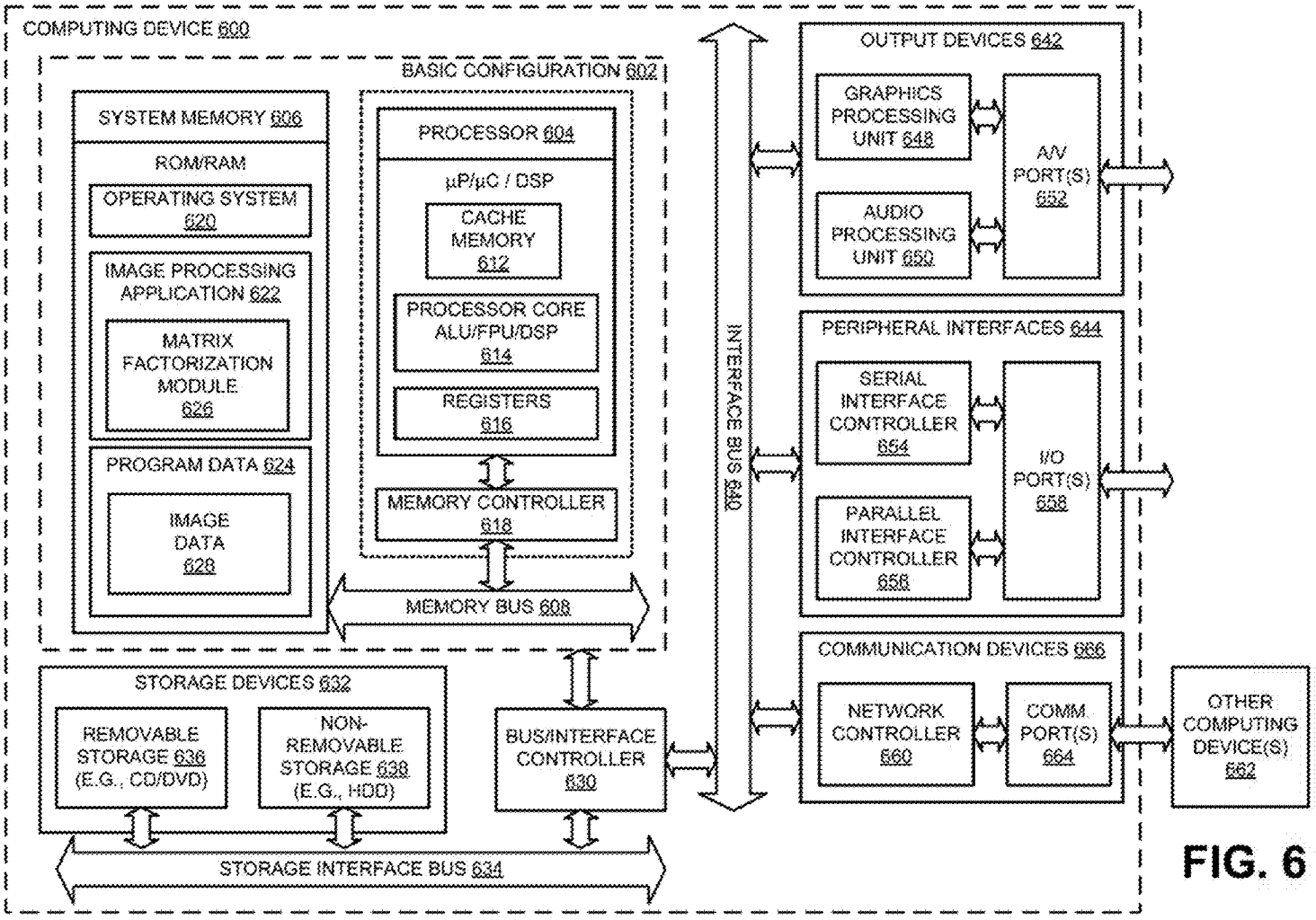
FIG. 6 illustrates a general purpose computing device, which may be used to implement matrix factorization based image processing using partial sum images.

FIG. 6 illustrates a general purpose computing device, which may be used to implement matrix factorization based image processing using approximation images in accordance with at least some embodiments described herein. In a very basic configuration 602, computing device 600 typically includes one or more processors 604 and a system memory 606. A memory bus 608 may be used for communicating between processor 604 and system memory 606.

Depending on the desired configuration, processor 604 may be of any type including but not limited to a microprocessor (μP), a microcontroller (μC), a digital signal processor (DSP), or any combination thereof. Processor 604 may include one more levels of caching, such as a cache memory 612, a processor core 614, and registers 616. Example processor core 614 may include an arithmetic logic unit (ALU), a floating point unit (FPU), a digital signal processing core (DSP Core), or any combination thereof. An example memory controller 618 may also be used with processor 604, or in some implementations memory controller 618 may be an internal part of processor 604.

Depending on the desired configuration, system memory 606 may be of any type including but not limited to volatile memory (such as RAM), non-volatile memory (such as ROM, flash memory, etc.) or any combination thereof. System memory 606 may include an operating system 620, an image processing application 622, and program data 624. Image processing application 622 may include a matrix factorization module 626 that is arranged to apply NNMF process to the source image data to generate partial sum image data, approximation image data, and residue image data in an iterative manner until a predetermined criterion is satisfied, sending the approximation image data to a display device and activating multiple row drivers and multiple column drivers for the display device during each sub-frame interval and any other processes, methods and functions as discussed above. Program data 624 may include one or more of image data 628 and similar data as discussed above in conjunction with at least FIG. 1 through FIG. 5. This data may be useful for processing still and video images to be displayed as is described herein. In some embodiments, image processing application 622 may be arranged to operate with program data 624 on operating system 620 performing matrix factorization through matrix factorization module 626 on image data 628. This described basic configuration 602 is illustrated in FIG. 6 by those components within the inner dashed line.

Computing device 600 may have additional features or functionality, and additional interfaces to facilitate communications between basic configuration 602 and any required devices and interfaces. For example, a bus/interface controller 630 may be used to facilitate communications between basic configuration 602 and one or more data storage devices 632 via a storage interface bus 634. Data storage devices 632 may be removable storage devices 636, non-removable storage devices 638, or a combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), and tape drives to name a few. Example computer storage media may include volatile and nonvolatile, removable and non-removable media implemented in any method or technology for storage of information, such as computer readable instructions, data structures, program modules, or other data.

System memory 606, removable storage devices 636 and non-removable storage devices 638 are examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which may be used to store the desired information and which may be accessed by computing device 600. Any such computer storage media may be part of computing device 600.

Computing device 600 may also include an interface bus 640 for facilitating communication from various interface devices (e.g., output devices 642, peripheral interfaces 644, and communication devices 666 to basic configuration 602 via bus/interface controller 630. Example output devices 642 include a graphics processing unit 648 and an audio processing unit 650, which may be configured to communicate to various external devices such as a display or speakers via one or more A/V ports 652. Example peripheral interfaces 644 include a serial interface controller 654 or a parallel interface controller 656, which may be configured to communicate with external devices such as input devices (e.g., keyboard, mouse, pen, voice input device, touch input device, etc.) or other peripheral devices (e.g., printer, scanner, etc.) via one or more I/O ports 658. An example communication device 666 includes a network controller 660, which may be arranged to facilitate communications with one or more other computing devices 662 over a network communication link via one or more communication ports 664.

The network communication link may be one example of a communication media. Communication media may typically be embodied by computer readable instructions, data structures, program modules, or other data in a modulated data signal, such as a carrier wave or other transport mechanism, and may include any information delivery media. A "modulated data signal" may be a signal that has one or more of its characteristics set or changed in such a manner as to encode information in the signal. By way of example, and not limitation, communication media may include wired media such as a wired network or direct-wired connection, and wireless media such as acoustic, radio frequency (RF), microwave, infrared (IR) and other wireless media. The term computer readable media as used herein may include both storage media and communication media.

Computing device 600 may be implemented as a portion of a physical server, virtual server, a computing cloud, or a hybrid device that include any of the above functions. Computing device 600 may also be implemented as a personal computer including both laptop computer and non-laptop computer configurations. Moreover computing device 600 may be implemented as a networked system or as part of a general purpose or specialized server.

Networks for a networked system including computing device 600 may comprise any topology of servers, clients, switches, routers, modems, Internet service providers, and any appropriate communication media (e.g., wired or wireless communications). A system according to embodiments may have a static or dynamic network topology. The networks may include a secure network such as an enterprise network (e.g., a LAN, WAN, or WLAN), an unsecure network such as a wireless open network (e.g., IEEE 802.11 wireless networks), or a world-wide network such (e.g., the Internet). The networks may also comprise a plurality of distinct networks that are adapted to operate together. Such networks are configured to provide communication between the nodes described herein. By way of example, and not limitation, these networks may include wireless media such as acoustic, RF, infrared and other wireless media. Furthermore, the networks may be portions of the same network or separate networks.

Figure 7:
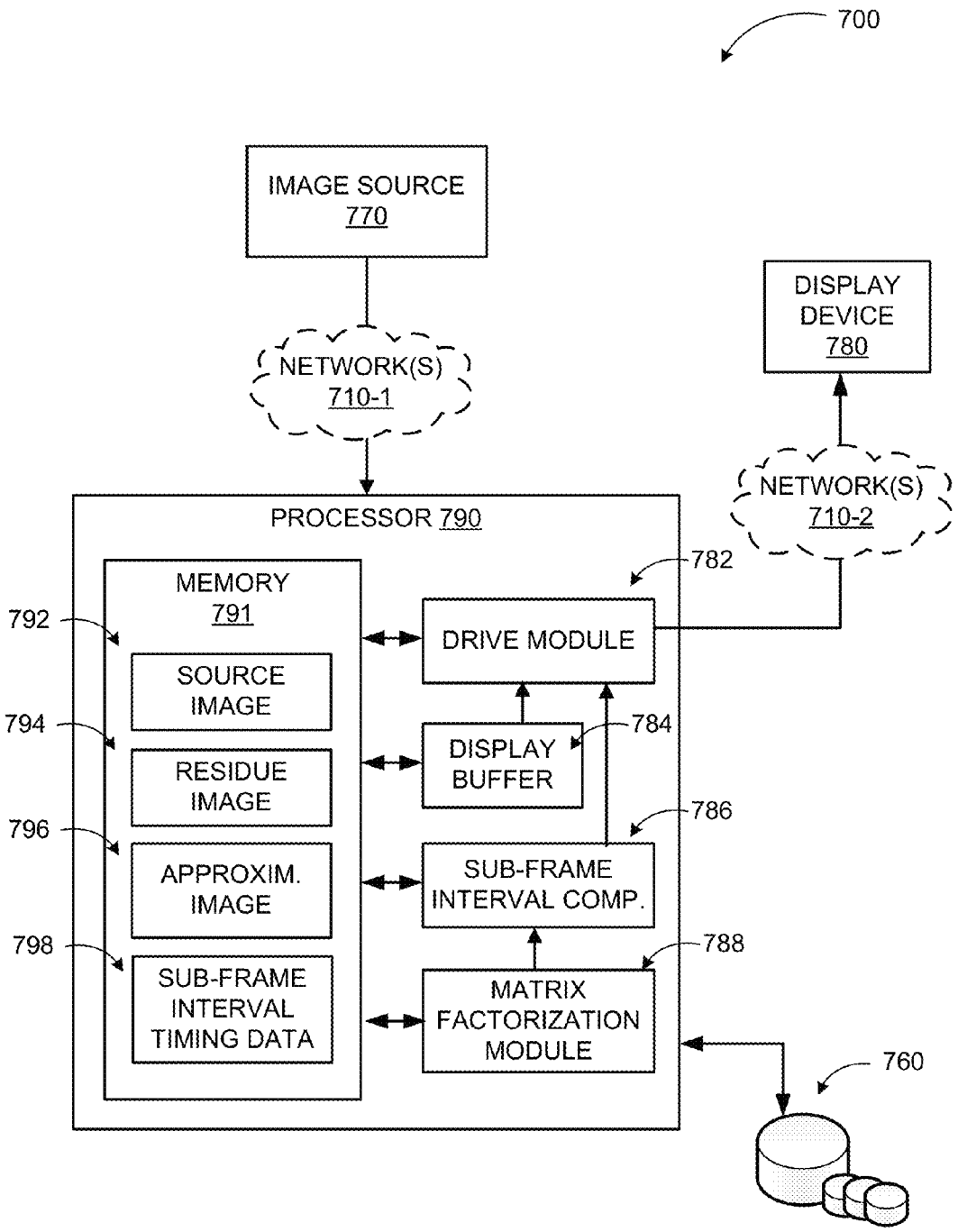
FIG. 7 illustrates a special purpose processor, which may be used to implement matrix factorization based image processing using approximation images.

FIG. 7 illustrates a special purpose processor, which may be used to implement matrix factorization based image processing using approximation images in accordance with various techniques described herein. Processor 790 in diagram 700 may be part of a computing device that is communicatively coupled to display device 780 through network(s) 710-2 or may be embedded into the display device 780.

Processor 790 may include a number of processing modules such as matrix factorization module 788, sub-frame interval computation module 786, display buffer 784, and drive module 782. In some example embodiments, one or more of memory 791, display buffer 784, and/or drive module 782 may be external to the processor 790. Source image data 792 may be provided to processor 790 from image source 770 (e.g. a camera, another computing device, a scanner, and comparable devices) directly or through network(s) 710-1. Matrix factorization module 788 may apply NNMF to the source image data 792 generating first approximation image data, and then iteratively to the residue image data to generate successive approximation image data 796 and residue image data 794. At each iterative step, the residue image data 794 may be compared to a predetermined threshold and the iterations terminated when the threshold is reached. At each iteration, respective approximation image data, $I_k$, may be stored in display buffer 784.

Upon completion of the iterations, non-overlapping sub-frame interval timing data 798 may be computed at sub-frame interval computation module 786. Approximation image data 796 and sub-frame interval timing data 798 may be sent (e.g., electrically coupled, or transmitted) from display buffer 784 to a controller of the display device 780 by drive module 782. Source image data 792, residue image data 794, approximation image data 796, and sub-frame interval timing data 798 may be stored during processing in memory 791, which may be a cache memory of the processor 790 or in an external memory (e.g., memory external to processor 790). Processor 790 may also be communicatively coupled to data stores 760, where at least some of the data may be stored during or following the processing of the source image.

Example embodiments may also include methods. These methods can be implemented in any number of ways, including the structures described herein. One such way of implementing a method is by machine operations, of devices of the type described in the present disclosure. Another optional way of implementing a method is for one or more of the individual operations of the methods to be performed in conjunction with one or more human operators performing some of the operations while other operations are performed by machines. These human operators need not be collocated with each other, but each can be only with a machine that performs a portion of the program. In other examples, the human interaction can be automated such as by pre-selected criteria that are machine automated.

Figure 8:
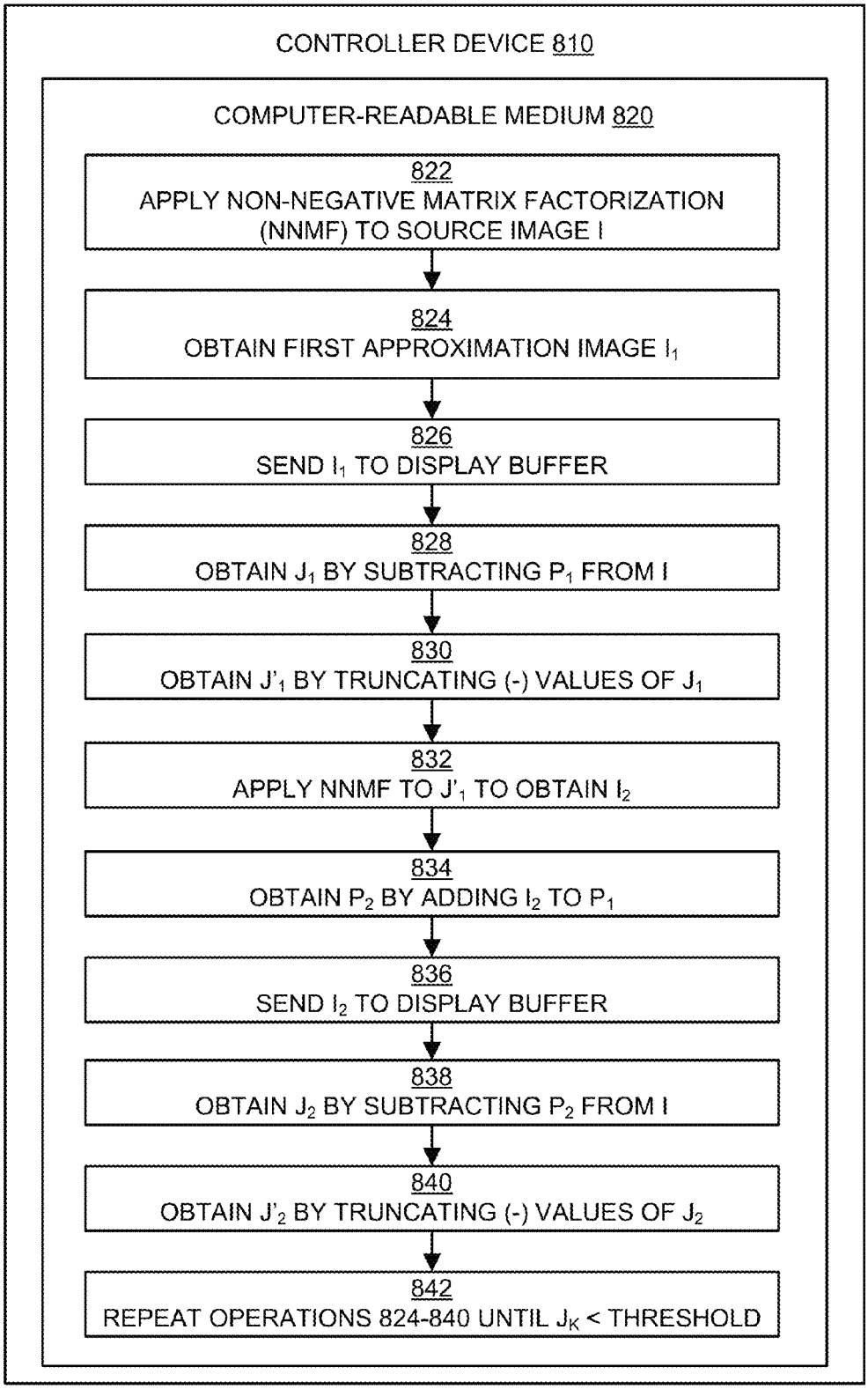
FIG. 8 is a flow diagram illustrating an example method for matrix factorization based image processing using approximation images that may be performed by a computing device such as device 600 in FIG. 6 or a special purpose processor such as processor 790 of FIG. 7.

FIG. 8 is a flow diagram illustrating an example method for matrix factorization based image processing using approximation images that may be performed by a computing device such as device 600 in FIG. 6 or a special purpose processor such as processor 790 of FIG. 7, arranged in accordance with at least some embodiments described herein. The method may include one or more operations, functions or actions as is illustrated by blocks 822, 824, 826, 828, 830, 832, 834, 836, 838, 840, and/or 842. The operations described in blocks 822 through 842 may be stored as computer-executable instructions in a computer-readable medium 820 such as the data storage devices 632 of the computing device 600 illustrated in FIG. 6 and executed by a controller device 810 such as processor 604 of computing device 600 of FIG. 6.

A process of matrix factorization based image processing using partial sum images may begin with operation 822, "APPLY NON-NEGATIVE MATRIX FACTORIZATION (NNMF) TO SOURCE IMAGE I." At operation 822, source image data, which may be represented as a separable non-negative matrix series, may be subjected to NNMF such that a partial sum image data, $P_1$, is obtained. Operation 822 may be followed by operation 824. At operation 824, "OBTAIN FIRST APPROXIMATION IMAGE $I_1$", a first approximation image, $I_1$, may be obtained. The series representation and the application of the NNMF may be performed by a processor such as the image processor 104 of FIG. 1.

Operation 824 may be followed by operation 826. At operation 826, "SEND $I_1$ TO DISPLAY BUFFER," $I_1$ may be sent (e.g., electrically coupled, or transmitted) from image processor 104 to display buffer 214 such that $I_1$ is displayed selectively activating multiple row drivers and multiple column drivers for the display device during the sub-frame interval associated with $I_1$ upon completion of the iterations. Operation 826 may be followed by operation 828. At operation 828, "OBTAIN $J_1$ BY SUBTRACTING $P_1$ FROM I," first residue image data $J_1$ may be obtained by subtracting $P_1$ from I. Operation 828 may be followed by operation 830. At operation 830, "OBTAIN $J'_1$ BY TRUNCATING (−) VALUES OF $J_1$", $J'_i$ may be obtained by truncating negative values of $J_1$.

Operation 830 may be followed by operation 832. At operation 832, "APPLY NNMF TO $J'_1$ TO OBTAIN $I_2$", the image processor 104 may apply the NNMF process again to $J'_1$ to obtain second approximation image data $I_2$ at the beginning of the second iteration. Operation 832 may be followed by operation 834. At operation 834, "OBTAIN $P_2$ BY ADDING $I_2$ TO $P_1$," the second partial sum image data $P_2$ may be obtained by adding the second approximation image data $I_2$ to the first partial sum image data $P_1$. The addition and subtraction operations may be performed using adders (e.g. 224, 226) as shown in diagram 200 of FIG. 2.

Operation 834 may be followed by operation 836. At operation 836, "SEND $I_2$ TO DISPLAY BUFFER," $I_2$ may be sent (e.g., electrically coupled, or transmitted) from image processor 104 to display buffer 214 such that $I_2$ is displayed selectively activating multiple row drivers and multiple column drivers for the display device during the sub-frame interval associated with $I_2$ upon completion of the iterations.

Operation 836 may be followed by operation 838. At operation 838, "OBTAIN $J_2$ BY SUBTRACTING $P_2$ FROM I," second residue image data $J_2$ may be obtained by subtracting $P_2$ from the original source image data I. Operation 838 may be followed by operation 840. At operation 840, "OBTAIN $J'_2$ BY TRUNCATING (−) VALUES OF $J_2$", $J'_2$ may be obtained by truncating negative values of $J_2$.

Operation 840 may be followed by operation 842. As shown in operation 842, "REPEAT OPERATIONS 824-840 UNTIL $J_K$<THRESHOLD," the operations 824 through 840 may be repeated iteratively until a predetermined threshold is reached. The predetermined threshold may be an energy threshold representing a percentage error in the displayed source image. The iterations may be terminated and the series truncated when the predetermined threshold is reached. An integration of the sub-frame images displayed over a complete frame interval by the human eye effectively corresponds to the source image.

Figure 9:
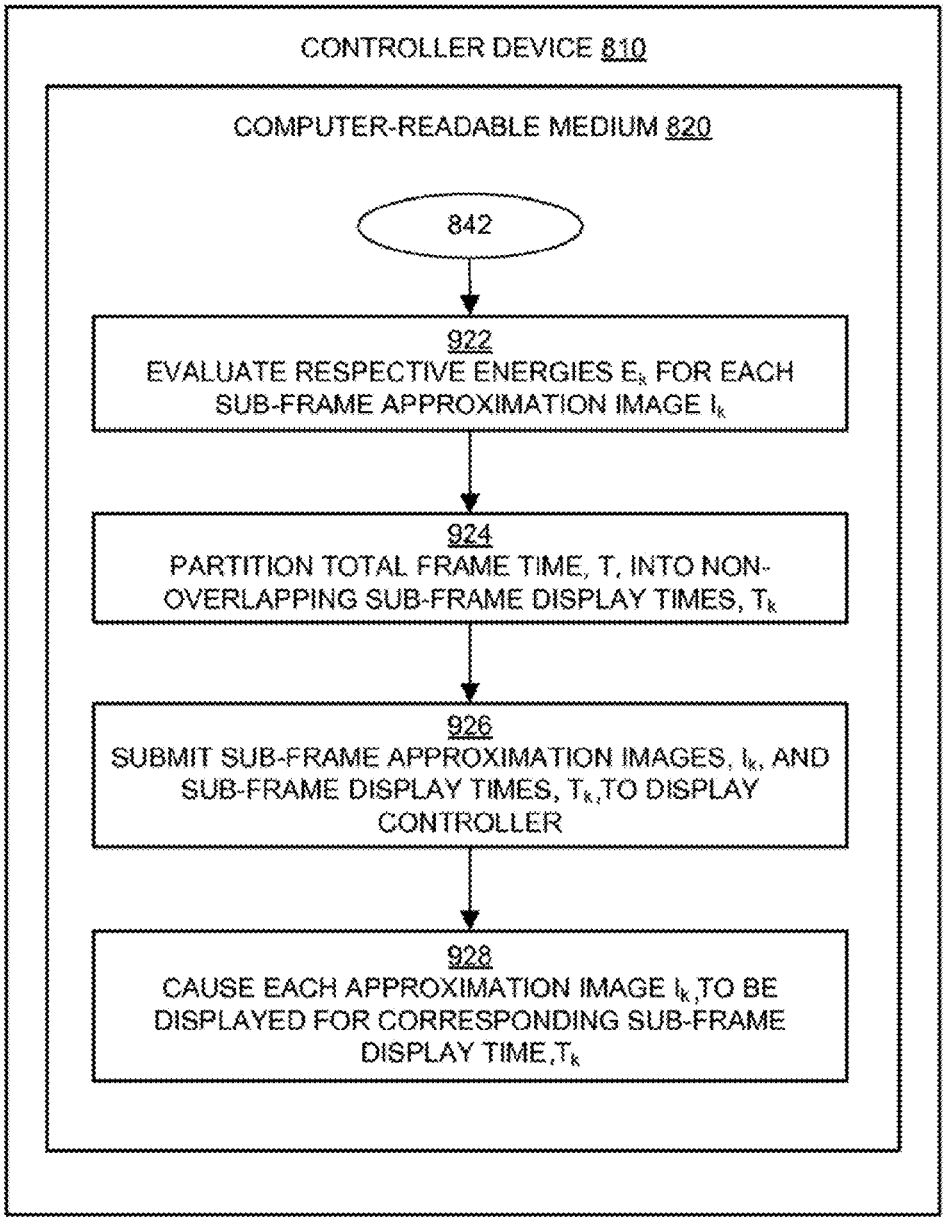
FIG. 9 is a flow diagram illustrating another example method for matrix factorization based image processing using approximation images following truncation of image data series as shown in FIG. 8.

FIG. 9 is a flow diagram illustrating another example method for matrix factorization based image processing using approximation images following truncation of image data series as shown in FIG. 8 according to at least some embodiments described herein. The method may include one or more operations, functions or actions as is illustrated by blocks 922, 924, 926, and/or 928. The operations described in blocks 922 through 928 may also be stored as computer-executable instructions in a computer-readable medium 820 such as data storage devices 632 of the computing device 600 illustrated in FIG. 6 and executed by a controller device 810 such as processor 604 of computing device 600 of FIG. 6.

The process FIG. 9 may follow operation 842 of FIG. 8 and begin with operation 922, "EVALUATE RESPECTIVE ENERGIES $E_k$ FOR EACH SUB-FRAME APPROXIMATION IMAGE $I_k$." At operation 922, respective energies, $E_k$ (k=1, 2, . . . , K), for each sub-frame approximation image data, $I_k$ (k=1, 2, . . . , K) may be evaluated (e.g., compared against a threshold as discussed above). Operation 922 may be followed by operation 924, "PARTITION TOTAL FRAME TIME, T, INTO NON-OVERLAPPING SUB-FRAME DISPLAY TIMES, $T_k$." At operation 924, non-overlapping sub-frame display times, $T_k$ (k=1, 2, . . . , K), may be computed at sub-frame interval computation block 212 of FIG. 2 according to the principle that $E_1/T_1=E_2/T_2= \ldots =E_K/T_K$.

Operation 924 may be followed by operation 926, "SUBMIT SUB-FRAME APPROXIMATION IMAGES, $I_k$, AND SUB-FRAME DISPLAY TIMES, $T_k$, TO DISPLAY CONTROLLER." At operation 926, all sub-frame approximation image data, $I_k$ (k=1, 2, . . . , K), stored in the display buffer 214 may be sent (e.g., electrically coupled, or transmitted) to display device 110 along with the sub-frame display times, $T_k$ (k=1, 2, . . . , K) obtained from the sub-frame interval computation block 212.

Operation 926 may be followed by operation 928, "CAUSE EACH APPROXIMATION IMAGE, $I_k$, TO BE DISPLAYED FOR CORRESPONDING SUB-FRAME DISPLAY TIME, $T_k$." At operation 928, the individual approximation images may be displayed through selective activation of multiple row drivers and multiple column drivers of the display device for corresponding sub-frame display times (e.g., $I_1$ for period $T_1$, $I_2$ for period $T_2$, . . . , $I_K$ for period $T_K$.

The operations included in the above described processes of FIG. 8 and FIG. 9 are for illustration purposes. Matrix factorization based image processing using approximation images may be implemented by similar processes with fewer or additional operations. In some examples, the operations may be performed in a different order. In some other examples, various operations may be eliminated. In still other examples, various operations may be divided into additional operations, or combined together into fewer operations.

Figure 10:
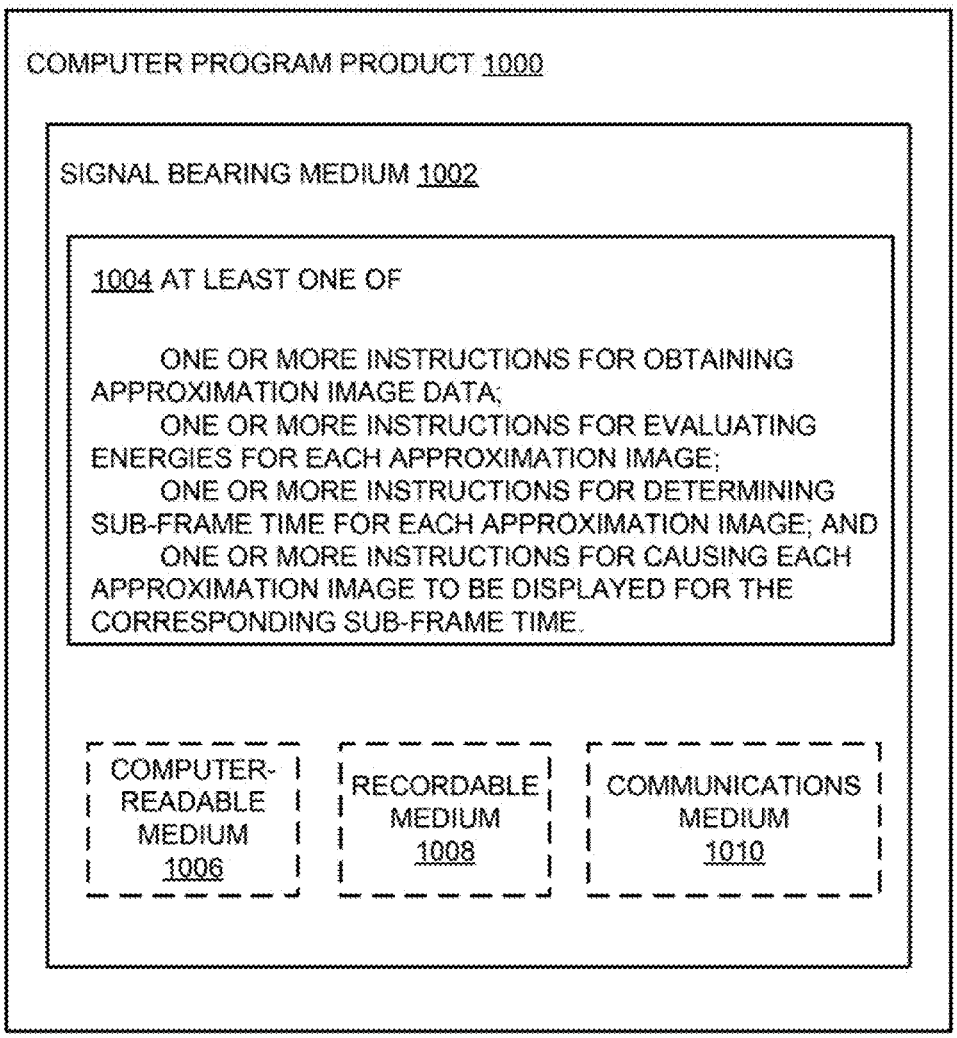
FIG. 10 illustrates a block diagram of an example computer program product, all arranged in accordance with at least some embodiments described herein.

FIG. 10 illustrates a block diagram of an example computer program product 1000, all arranged in accordance with at least some embodiments described herein. In some examples, as shown in FIG. 10, computer program product 1000 may include a signal bearing medium 1002 that may also include machine readable instructions 1004 that, when executed by, for example, a processor, may provide the functionality described above with respect to FIG. 6. For example, referring to the computing device 600, the matrix factorization module 626 may undertake one or more of the tasks shown in FIG. 10 in response to instructions 1004 conveyed to the processor 604 by the medium 1002 to perform actions associated with convergent matrix factorization based entire image processing as described herein. Some of those instructions may be include obtaining approximation image data, evaluating energies for each approximation image, determining sub-frame time for each approximation image, and causing each approximation image to be displayed for the corresponding sub-frame time.

In some implementations, the signal bearing medium 1002 depicted in FIG. 8 may encompass a computer-readable medium 1006, such as, but not limited to, a hard disk drive, a Compact Disc (CD), a Digital Versatile Disk (DVD), a digital tape, memory, etc. In some implementations, signal bearing medium 1002 may encompass a recordable medium 1008, such as, but not limited to, memory, read/write (R/W) CDs, R/W DVDs, etc. In some implementations, the signal bearing medium 1002 may encompass a communications medium 1010, such as, but not limited to, a digital and/or an analog communication medium (e.g., a fiber optic cable, a waveguide, a wired communications link, a wireless communication link, etc.). For example, program product 1000 may be conveyed to one or more modules of the processor 790 by an RF signal bearing medium, where the signal bearing medium 1002 is conveyed by a wireless communications medium 1010 (e.g., a wireless communications medium conforming with the IEEE 802.11 standard).

The present disclosure generally presents methods for generating drive signals for a display device to display a source image responsive to source image data. Example methods may include applying a non-negative matrix factorization (NNMF) process to the source image data to generate approximation image data, partial sum image data and residue image data. Some methods may also include iteratively applying the NNMF process to residue image data to generate subsequent approximation image data, partial sum image data and residue image data, where each approximation image data is associated with a corresponding sub-frame image. According to some methods, for each application of the NNMF process: the approximation image data may be sent (e.g., electrically coupled, or transmitted) to a display buffer, a determination may be made if a predetermined criterion is satisfied, and the iterations may continue until the predetermined criterion is satisfied. A total frame time may be partitioned into sub-frame times based on respective computed sub-frame image energies. The computed sub-frame images may be sent to the display device to selectively activate multiple row drivers and multiple column drivers for the display device for a duration based on corresponding sub-frame times associated with each sub-frame image.

According to some examples, methods may further include obtaining first approximation image data, which is a first partial sum image data, obtaining first residue image data by subtracting the first partial sum image data from the source image data, obtaining first truncated residue image data by truncating negative values of the first residue image data, and obtaining second approximation image data by applying the NNMF to the first truncated residue image data. According to other examples, methods may also include obtaining second partial sum image data by adding the second approximation image data to the first partial sum image data, obtaining second residue image data by subtracting the second partial sum image data from the source image data, and obtaining second truncated residue image data by truncating negative values of the second residue image data, where the first and second approximation image data are sent (e.g., electrically coupled, or transmitted) to the display buffer as they are obtained.

According to further examples, a first sub-frame image may carry about 90% of source image energy. The predetermined criterion may include one or more threshold that includes: an energy fidelity, a perceptual fidelity, a time limitation in context of packet based communication, a buffer size limitation, and/or a frame count limitation. The thresholds may be concurrently evaluated and the iterations terminated if at least one of the thresholds is reached. The total frame time may be partitioned into sub-frame times based on one or more of selecting the sub-frame times based on respective image energies, dividing the total frame time into equal portions, or a default partitioning scheme associated with a predefined function. According to yet other examples, methods may also include terminating the iterations after $10^{th}$ sub-frame images, and/or performing the iterations and sending the approximation image data to the display for each color channel in a color display.

The present disclosure also generally presents apparatuses for generating drive signals for a display device to display a source image responsive to source image data. An example apparatus may include a memory configured to store instructions source image data and a processor coupled to the memory, where the processor is adapted to execute the instructions. When the instructions are executed the processor may apply a non-negative matrix factorization (NNMF) process to the source image data to generate approximation image data, partial sum image data and residue image data, and iteratively apply the NNMF process to residue image data to generate subsequent approximation image data, partial sum image data and residue image data, where each approximation image data is associated with a corresponding sub-frame image. For each application of the NNMF process: the approximation image data may be sent (e.g., electrically coupled, or transmitted) to a display buffer, a determination may be made if a predetermined criterion is satisfied, and the iterations may continue until the predetermined criterion is satisfied. A total frame time partitioned into respective sub-frame times based on respective computed sub-frame image energies. The apparatus may also include a display buffer, which may be configured to send the stored sub-frame images to the display device such that multiple row drivers and multiple column drivers for the display device are selectively activated for a duration based on corresponding sub-frame times associated with each sub-frame image.

According to some examples, the apparatus may be configured to obtain first approximation image data based on the partial sum image data, obtain first residue image data through subtraction of the first partial sum image data from the source image data, obtain first truncated residue image data through truncation of negative values of the first residue image data, and obtain second approximation image data through application of the NNMF to the first truncated residue image data. Some apparatus may also be configured to obtain second partial sum image data through addition of the second approximation image data to the first partial sum image data, obtain second residue image data through subtraction of the second partial sum image data from the source image data, and obtain second truncated residue image data through truncation of negative values of the second residue image data.

According to other examples, the partial sum image data may be represented in the form of a convergent series of separable matrices, each term of which can be loaded at once into an array through excitation of rows and columns of the display device together, and where each sub-frame image may represent an approximation of the source image comprising a largest collection of simultaneously excited pixels.

According to further examples, a processor of the apparatus may be configured to cause a display controller to time-switch row electrodes to feed column electrodes such that a column current is maintained substantially constant throughout a sub-frame interval. The predetermined threshold may be based on one of: an energy fidelity, a perceptual fidelity, a time limitation in context of packet based communication, a buffer size limitation, and a frame count limitation and the processor may be further configured to terminate the iterations at about 5% energy fidelity threshold.

According to yet other examples, the processor may configured to perform one set of iterations for gray scale images and three sets of iterations for color images, each set of iterations being associated with a color channel. The processor may be a main processor of a general purpose computing device or a special purpose processor. The display may be made of OLED based display arrays, and substantially all elements of the display arrays may be addressed simultaneously.

The present disclosure also generally describes computer-readable storage medium having instructions stored thereon for generating drive signals for a display device to display a source image responsive to source image data. Example instructions may include generating a Separable Non-negative Matrix Series Representation (SNMSR) of the source image data, applying a non-negative matrix factorization (NNMF) process to the source image data to generate approximation image data, partial sum image data and residue image data, and iteratively applying the NNMF process to residue image data to generate subsequent approximation image data, partial sum image data and residue image data, where each approximation image data is associated with a corresponding sub-frame image. For each application of the NNMF process: the approximation image data may be sent (e.g., electrically coupled, or transmitted) to a display buffer, a determination may be made if a predetermined criterion is satisfied, and the iterations continued until the predetermined criterion is satisfied. The series may be truncated when the predetermined criterion is satisfied, where an integration of the sub-frame images displayed over a complete frame interval effectively corresponds to the source image.

According to some examples, each term in the series may be represented as a unit rank image matrix arranged to contribute to an approximation of displayed source image. Factors of each unit rank image matrix may be utilized to directly drive a display current and ground electrodes of the display. Moreover, the factors of each unit rank image matrix may be employed to time-switch row electrodes to feed column electrodes maintaining a column current substantially constant throughout a sub-frame interval. Each member of the truncated series may be displayed once during a sub-frame interval.

According to further examples, the predetermined criterion may include one or more thresholds comprising: an energy fidelity, a perceptual fidelity, a time limitation in context of packet based communication, a buffer size limitation, and/or a frame count limitation. The thresholds may be evaluated concurrently and the iterations terminated if at least one of the thresholds is reached. Furthermore, the total frame time may be partitioned into sub-frame times based on one or more of selecting the sub-frame times based on respective image energies, dividing the total frame time into equal portions, and a default partitioning scheme associated with a predefined function.

There is little distinction left between hardware and software implementations of aspects of systems; the use of hardware or software is generally (but not always, in that in certain contexts the choice between hardware and software may become significant) a design choice representing cost vs. efficiency tradeoffs. There are various vehicles by which processes and/or systems and/or other technologies described herein may be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation; or, yet again alternatively, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples may be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, may be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and/or firmware would be well within the skill of one of skill in the art in light of this disclosure.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, materials, and configurations, which can, of course, vary. It is also to be understood that the terminology used herein is for the purpose of describing particular embodiments only, and is not intended to be limiting.

In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Versatile Disk (DVD), a digital tape, a computer memory, etc.; and a transmission type medium such as a digital and/or an analog communication medium (e.g., a fiber optic cable, a waveguide, a wired communications link, a wireless communication link, etc.).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein may be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control modules (e.g., adjusting matrix factorization parameters such as the predetermined threshold for terminating iterations).

A typical data processing system may be implemented utilizing any suitable commercially available components, such as those typically found in data computing/communication and/or network computing/communication systems. The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermediate components. Likewise, any two components so associated may also be viewed as being "operably connected", or "operably coupled", to each other to achieve the desired functionality, and any two components capable of being so associated may also be viewed as being "operably couplable", to each other to achieve the desired functionality. Specific examples of operably couplable include but are not limited to physically connectable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. For example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method to generate drive signals for a display device to display a source image responsive to source image data, the method comprising:

applying a non-negative matrix factorization (NNMF) process to the source image data to generate approximation image data, partial sum image data, and residue image data, wherein the source image data is expressed as a convergent series of separable matrices;

loading each term of the convergent series into one or more display arrays simultaneously by an excitation process of rows and columns of the one or more display arrays, wherein active rows of the one or more display arrays are configured to be driven during a frame interval and inactive rows of the one or more display arrays are configured to be driven during a different frame interval from the active rows, and wherein each term in the convergent series is a unit rank image matrix arranged to contribute an approximation of the source image;

driving a display current and ground electrodes of the display device through use of factors of each unit rank image matrix, wherein the factors of each unit rank image matrix are employed to time-switch row electrodes to feed column electrodes so as to maintain a column current constant throughout a sub-frame interval;

iteratively applying the NNMF process to residue image data to generate subsequent approximation image data, partial sum image data, and residue image data, wherein each approximation image data is associated with a corresponding sub-frame image; for each application of the NNMF process:

sending the approximation image data from an image processor to a display buffer; and continuing iterations of the NNMF process until a criterion based on a threshold that includes one or more of a time limitation, a buffer size limitation, and a frame count limitation is satisfied;

partitioning a total frame time into one or more sub-frame times associated with each sub-frame image, wherein one or more of a first sub-frame image, a second sub-frame image, and a third sub-frame image contain a majority of source image energy of the source image, and wherein the first sub-frame image, the second sub-frame image, and the third sub-frame image include 90% of the source image energy;

detecting an energy based approximation error of the source image, wherein the energy based approximation error is a difference between the source image and the approximation of the source image viewed by a user;

determining a convergence of the energy based approximation error based on a complexity of the source image and a number of colors in the source image; and sequentially sending a computed approximation image data for each sub-frame image to the display device to selectively activate multiple row drivers and multiple column drivers of the display device for a duration based on a corresponding sub-frame time, wherein each iteration of the NNMF process comprises:

obtaining first approximation image data and first partial sum image data;

obtaining first residue image data by subtracting the first partial sum image data from the source image data;

obtaining first truncated residue image data by truncating negative values of the first residue image data; and obtaining second approximation image data by applying non-negative matrix factorization to the first truncated residue image data.

2. The method according to claim 1, wherein each iteration further comprises:

obtaining second partial sum image data by adding the second approximation image data to the first partial sum image data;

obtaining second residue image data by subtracting the second partial sum image data from the source image data; and obtaining second truncated residue image data by truncating negative values of the second residue image data.

3. The method according to claim 2, further comprising sending the first and second approximation image data to the display buffer as they are obtained.

4. The method according to claim 1, further comprising evaluating the threshold concurrently and terminating the iterations of the NNMF process in response to reaching the threshold.

5. The method according to claim 1, wherein the total frame time is partitioned into one or more sub-frame times based on one or more of selecting the sub-frame times based on respective image energies, dividing the total frame time into equal portions, and a default partitioning scheme associated with a particular function.

6. The method according to claim 1, further comprising sending the approximation image data and corresponding sub-frame times to the display device for each color channel in a color display.

7. An apparatus to generate drive signals for a display device to display a source image responsive to source image data, comprising:

a memory configured to store instructions and source image data; one or more display arrays, wherein active rows of the one or more display arrays are configured to be driven during a frame interval and inactive rows of the one or more display arrays are configured to be driven during a different frame interval from the active rows;

a processor coupled to the memory and the one or more display arrays, wherein the processor is adapted to execute the instructions, which in response to execution configure the processor to perform or cause to be performed:

apply a non-negative matrix factorization (NNMF) process to the source image data to generate approximation image data, partial sum image data, and residue image data, wherein the source image data is expressed as a convergent series of separable matrices;

load each term of the convergent series into the one or more display arrays simultaneously by an excitation process of columns and the rows of the one or more display arrays, wherein each term in the convergent series is a unit rank image matrix arranged to contribute an approximation of the source image;

drive a display current and ground electrodes of the display device through use of factors of each unit rank image matrix, wherein the factors of each unit rank image matrix are employed to time-switch row electrodes to feed column electrodes so as to maintain a column current constant throughout a sub-frame interval;

iteratively apply the NNMF process to residue image data to generate subsequent approximation image data, partial sum image data, and residue image data, wherein each approximation image data is associated with a corresponding sub-frame image, and an energy of each sub-frame image is determined partially from activated pixels for a corresponding sub-frame;

for each application of the NNMF process:

send the approximation image data at each iteration of the NNMF process from the processor to a display buffer; and continue iterations of the NNMF process until a criterion based on a threshold that includes one or more of a time limitation, a buffer size limitation, and a frame count limitation is satisfied; and partition a total frame time into one or more sub-frame times associated with each sub-frame image, wherein one or more of a first sub-frame image, a second sub-frame image, and a third sub-frame image contain a majority of source image energy of the source image and, wherein the first sub-frame image, the second sub-frame image, and the third sub-frame image include 90% of the source image energy;

detect an energy based approximation error of the source image, wherein the energy based approximation error is a difference between the source image and the approximation of the source image viewed by a user; and determine a convergence of the energy based approximation error based on a complexity of the source image and a number of colors in the source image; and the display buffer configured to send stored approximation image data for each sub-frame image to the display device such that multiple row drivers and multiple column drivers for the display device are selectively activated for a duration based on a corresponding sub-frame time, wherein at each iteration of the NNMF process, the processor is further configured to perform or cause to be performed:

obtain first approximation image data and a first partial sum image data; obtain first residue image data through subtraction of the first partial sum image data from the source image data;

obtain first truncated residue image data through truncation of negative values of the first residue image data;

obtain second approximation image data through application of the NNMF to the first truncated residue image data;

obtain second partial sum image data through addition of the second approximation image data to the first partial sum image data;

obtain second residue image data through subtraction of the second partial sum image data from the source image data; and obtain second truncated residue image data through truncation of negative values of the second residue image data.

8. The apparatus according to claim 7, wherein the processor is further configured to cause a display controller to time-switch row electrodes to feed the column electrodes such that the column current is maintained constant throughout the sub-frame interval.

9. The apparatus according to claim 7, wherein the display device comprises organic light emitting diode (OLED) based display arrays and all elements of the one or more display arrays are addressed simultaneously.

10. A non-transitory computer-readable storage medium that includes instructions stored thereon to generate drive signals for a display device to display a source image responsive to source image data, the instructions being executable by a processor to perform or cause to be performed a method comprising:

generating a separable non-negative matrix series representation (SNMSR) of the source image data by:

applying a non-negative matrix factorization (NNMF) process to the source image data to generate approximation image data, partial sum image data, and residue image data, wherein the source image data is expressed as a convergent series of separable matrices;

loading each term of the convergent series into one or more display arrays simultaneously by an excitation process of rows and columns of the one or more display arrays, wherein active rows of the one or more display arrays are configured to be driven during a frame interval and inactive rows of the one or more display arrays are configured to be driven during a different frame interval from the active rows, and wherein each term in the convergent series is a unit rank image matrix arranged to contribute an approximation of the source image;

driving a display current and ground electrodes of the display device through use of factors of each unit rank image matrix, wherein the factors of each unit rank image matrix are employed to time-switch row electrodes to feed column electrodes so as to maintain a column current constant throughout a sub-frame interval;

iteratively applying the NNMF process to residue image data to generate subsequent approximation image data, partial sum image data, and residue image data, wherein each approximation image data is associated with a corresponding sub-frame image;

for each application of the NNMF process:

sending the approximation image data from the processor to a display buffer;

continuing iterations of the NNMF process until a criterion based on a threshold that includes one or more of a time limitation, a buffer size limitation, and a frame count limitation is satisfied; and truncating an SNMSR series in response to satisfaction of the criterion, wherein an integration of sub-frame images displayed over a complete frame interval effectively corresponds to the source image, wherein one or more of a first sub-frame image, a second sub-frame image, and a third sub-frame image contain a majority of source image energy of the source image and, wherein the first sub-frame image, the second sub-frame image, and the third sub-frame image include 90% of the source image energy;

detecting an energy based approximation error of the source image, wherein the energy based approximation error is a difference between the source image and the approximation of the source image viewed by a user;

determining a convergence of the energy based approximation error based on a complexity of the source image and a number of colors in the source image; and wherein each iteration of the NNMF process comprises:

obtaining first approximation image data and first partial sum image data;

obtaining first residue image data by subtracting the first partial sum image data from the source image data;

obtaining first truncated residue image data by truncating negative values of the first residue image data; and obtaining second approximation image data by applying non-negative matrix factorization to the first truncated residue image data.

11. The non-transitory computer-readable storage medium according to claim 10, wherein a total frame time is partitioned into sub-frame times based on one or more of selecting the sub-frame times based on respective image energies, dividing the total frame time into equal portions, and a default partitioning scheme associated with a predefined function.

* * * * *

UNITED STATES PATENT AND TRADEMARK OFFICE

CERTIFICATE OF CORRECTION

PATENT NO. : 9,311,897 B2
APPLICATION NO. : 13/264712
DATED : April 12, 2016
INVENTOR(S) : Subramanian et al.

It is certified that error appears in the above-identified patent and that said Letters Patent is hereby corrected as shown below:

In the specification

Column 1, Line 9, delete "§371" and insert -- § 371 --, therefor.

Column 4, Line 17, delete "interval. At" and insert -- interval, where a sub-frame interval is a duration based on corresponding sub-frame time. At --, therefor.

Signed and Sealed this
Fifth Day of July, 2016

Michelle K. Lee

Michelle K. Lee
*Director of the United States Patent and Trademark Office*